United States Patent [19]

Roe

[11] 4,120,494

[45] Oct. 17, 1978

[54] POCKET BILLARD TRAINING DEVICE

[76] Inventor: Hjalmer E. Roe, 5948 Gany Mede Dr., Toledo, Ohio 43623

[21] Appl. No.: 772,245

[22] Filed: Feb. 25, 1977

[51] Int. Cl.[2] ..... A63D 15/00

[52] U.S. Cl. ..... 273/2

[58] Field of Search ..... 273/2, 14, 3 R, 3 A, 273/6, 7; 35/29 A, 29 B, 29 C, 29 D, 29 E, 29 R; 128/DIG. 15

[56] References Cited

U.S. PATENT DOCUMENTS

| | | | |
|---|---|---|---|
| 3,094,330 | 6/1963 | Smith | 128/DIG. 15 |
| 3,220,122 | 11/1965 | Miller | 273/14 |
| 3,299,537 | 1/1967 | Franks | 273/14 |
| 3,704,887 | 12/1972 | Thoron | 273/14 |
| 3,949,987 | 4/1976 | Candor | 35/29 X |

*Primary Examiner*—Richard C. Pinkham
*Assistant Examiner*—T. Brown
*Attorney, Agent, or Firm*—Richard D. Emch

[57] ABSTRACT

A pocket billiards training device is disclosed. A layer of planar material having an area less than the playing area of a billiard table is positioned on the table. Identifying indicia such as a plurality of colored layers or lines are on the upper surface of the planar material for guiding a player in making predetermined billiard shots. The lower surface of the planar material is provided with nap or adhesive material for gripping the billiard table playing surface.

10 Claims, 4 Drawing Figures

POCKET BILLARD TRAINING DEVICE

BACKGROUND OF THE INVENTION

To play pocket billiards successfully requires two things: (1) knowledge of where to strike the cue and object balls to produce the desired result, and (2) the skill to make the shot correctly. The knowledge is obtained through personal instruction, readily available literature, or experience. However, the present method of adapting that knowledge to practical use on the billiard table consists of trial-and-error reproduction of individual shots. The player does this by "eye-balling" both the desired point of impact between the cue stick and the cue ball, and between the cue ball and the object ball, and then attempting the shot. Because of the variation in "eye-balling" between each shot, that method necessarily requires a great many shots before the player develops the skill to make it properly and consistently. Thus, the skill to make the shot correctly is the result only of a great deal of practice.

SUMMARY OF THE PRESENT INVENTION

The present invention is a training device for improving one's accuracy and skill in the game of pocket billiards.

It is a primary object of this invention to provide a player with a device which would allow him to practice all types of billiard shots consistently and precisely. It is a further object of this invention to assist the player in developing a proper follow-through stroke and a speed stroke. Another object is to assist the player in learning the proper stance for desired accuracy.

DETAILED DESCRIPTION OF THE PREFERRED EMBODIMENTS

Figure 1:
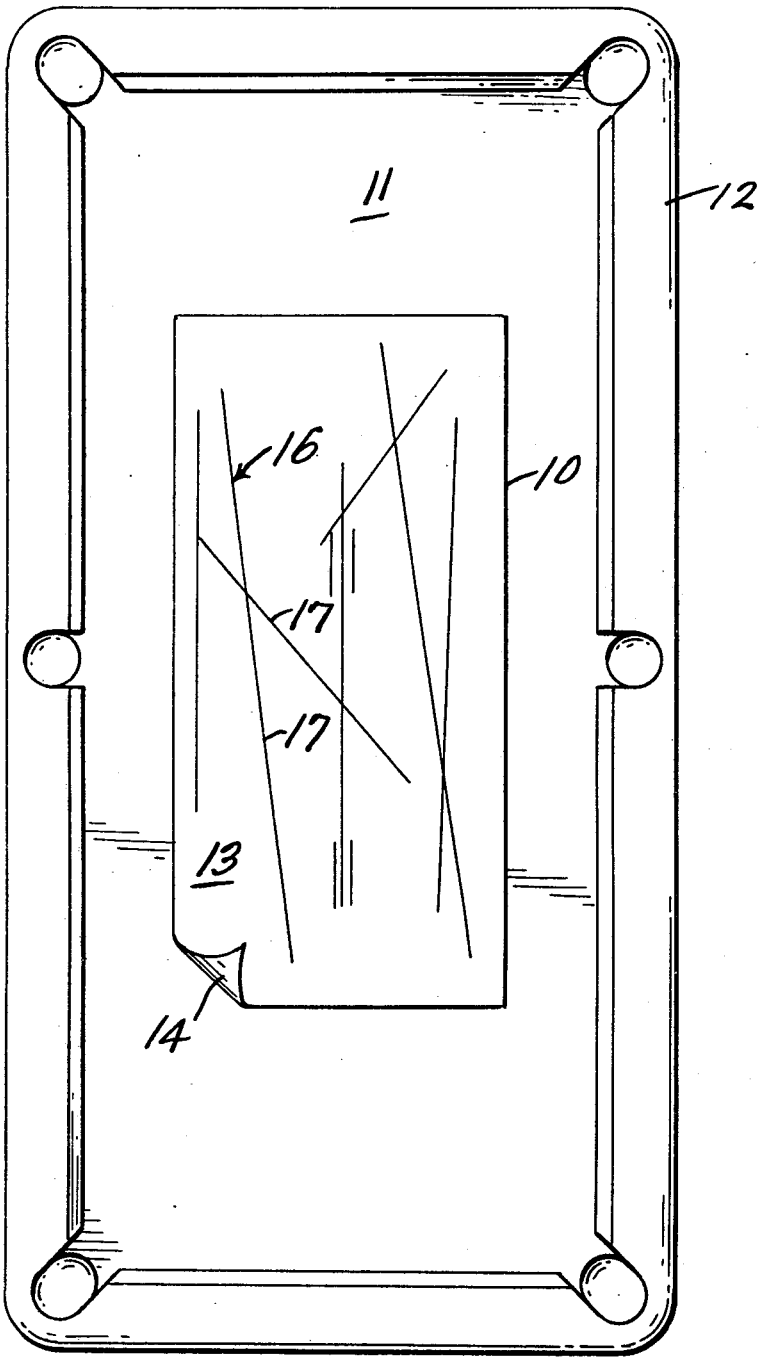
FIG. 1 is an overall plan view of the training device, according to the present invention, as it would appear in relation to a billiard table.

Referring to FIG. 1, a pocket billiards training device according to the present invention is indicated by the reference number 10. The training device 10 is positioned on a playing area 11 of a billiard table 12.

The pocket billiards training device 10 comprises a layer of planar material having an upper surface 13 and a lower surface 14. The planar material may comprise a layer of cloth, for example, regulation billiard cloth, or as alternatives, a layer of plastic material or a layer of paper material.

Identifying means, generally indicated by the reference number 16, are located on the upper surface 13 of the training device 10. In the illustrated embodiment, the identifying means 16 comprise individual layers 17 of pre-arranged indicia of a color contrasting to the color of the upper surface 13 of the training device 10. For example, if the upper surface 13 of the training device 10 is green in color, the individual layers 17 are white or a similar contrasting color.

Preferably, the lower surface 14 of the training device 10 includes means for gripping the billiard table playing area 11. In the disclosed embodiment, shown in FIG. 1, the training device 10 consists of a layer of billiard cloth including a lower surface 14, wherein the nap of the lower surface 14 serves as the means for gripping the playing area 11. In other embodiments, the gripping means may comprise strips of adhesive materials or a layer of adhesive material.

Referring to FIG. 1, it is noted that the identifying means 16 consisting of the individual layers 17 serve as guidelines on the upper surface 13 wherein individual billiard shots may be practiced.

In practicing the method of the invention, the training device 10 comprising the sheet of planar material having identifying layers or guidelines 17 on its upper surface 13 is positioned on the playing area 11 of the billiard table 12. The training device or sheet 10 is aligned, thereby aligning a respective guideline layer 17 for performance of a desired billiard shot. As described in further detail below, a cue ball is positioned at an indicated location adjacent the individual guideline 17 and the cue ball is stroked with a standard pool cue. The follow-through movement is continued with the tip of the pool cue being guided along the individual guideline 17, wherein the desired billiard shot is correctly performed.

While size of the training device 10 may be varied, the present embodiment is approximately 20½ inches wide by 44 inches long. This size of training device 10 enables the device to be used on both a regulation size and smaller size home billiard tables.

Figure 2:
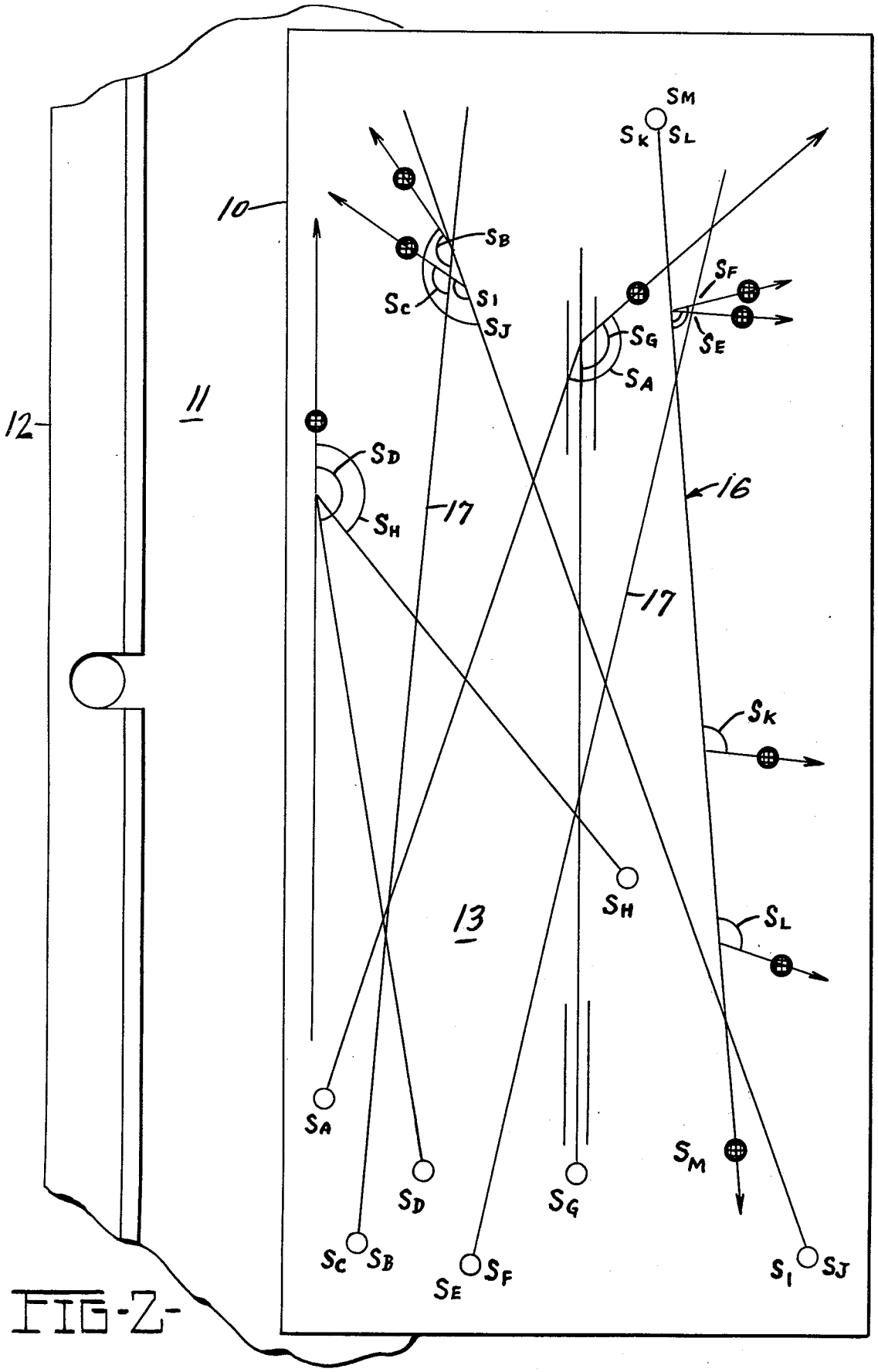
FIG. 2 is a fragmentary plan view of the training device on a billiard table, showing the identifying means for setting up and practicing various shots.

FIG. 2 is an overall view of the practice or training device 10 illustrating the identifying means 16 for predetermined shots in greater detail. Each shot is represented by two letters at the location of the cue ball (white circles) and at the point of impact between the cue ball and the object ball (black circles); a line of travel for the cue ball and guideline for the cue stick; and the resulting line of travel for the object ball. The point of impact is defined, for purposes herein, as being the point on the cue ball line of travel at which the cue ball makes initial contact with the object ball. The predetermined point of impact and the center of the predetermined object ball position are always one ball diameter apart. The following shots are identified in the drawing:

| Letter Identification | Type of Shot |
|---|---|
| SA | 155° spot shot |
| SB | 135° shot (cut) |
| SC | 115° shot (cut) |
| SD | 170° shot (rail) |
| SE | 110° shot (cut) |
| SF | 120° shot (cut) |
| SG | 130° shot (cut) |
| SH | 140° shot (rail) |
| SI | 140° shot (cut) |
| SJ | 160 ° shot (cut) |
| SK | 100° shot (side pocket cut) |
| SL | 110° side pocket cut shot |
| SM | 180° straight shot |

The device is used to practice the predetermined shots by placing the device on the billiard table 12 such that the line of travel identified for the object ball is aimed toward the desired pocket. The player then places the cue and object balls on the appropriately identified locations for the desired predetermined shot; aims the cue stick such that it coincides with the line of travel identified for the cue ball; and then strokes the cue stick so that it impacts the cue ball, causing it to follow the identified line of travel and strike the object ball in the desired manner. The identified lines of travel 17 enable the player to observe his mistakes if he misses the shot. He may then easily repeat the exact same shot until he develops the necessary skill in coordinating eye sighting, stance, and shooting to perform the shot consistently in the desired manner.

Figure 3:
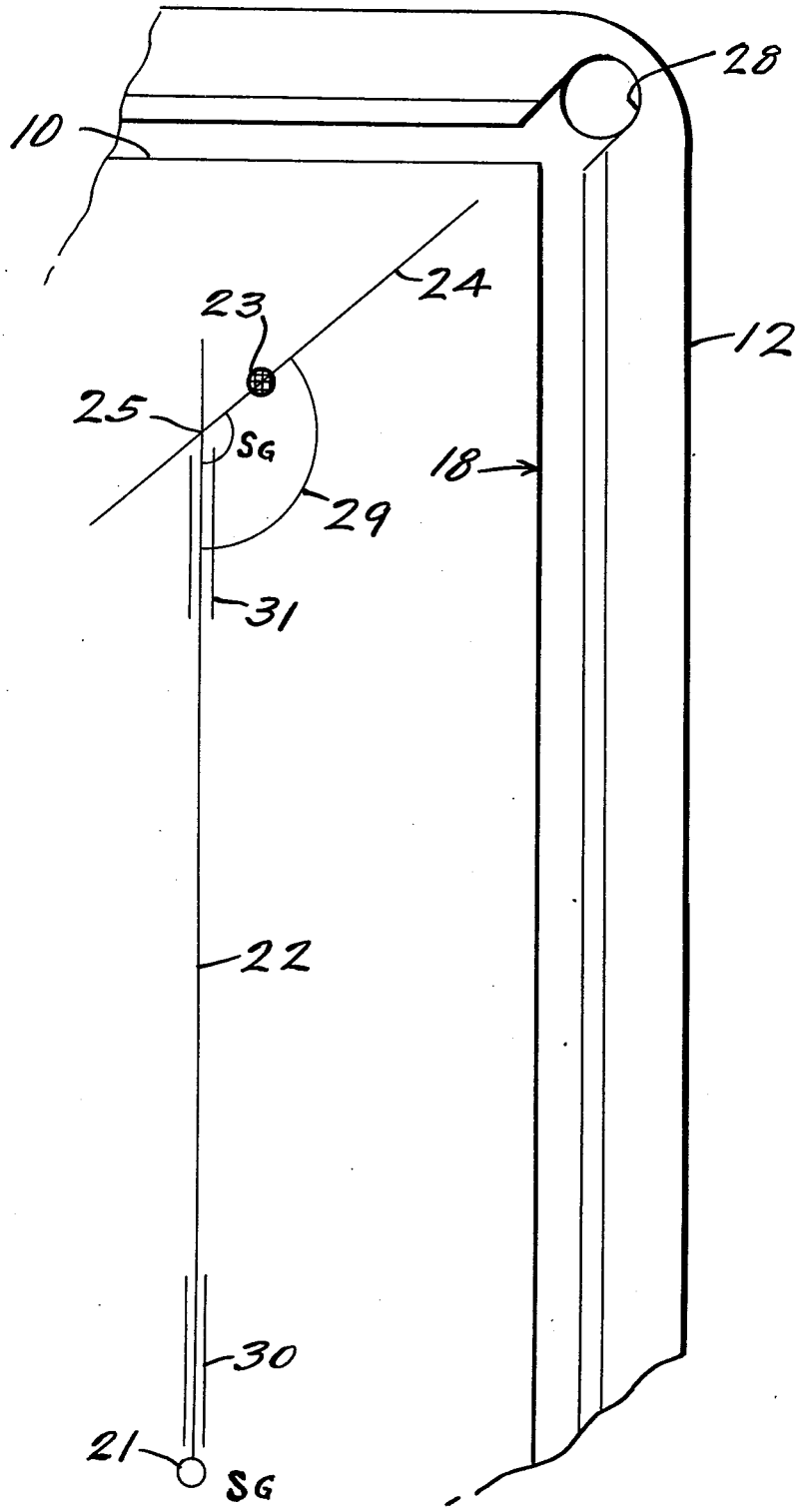
FIG. 3 is a partial plan view of the training device on a billiard table, showing the identifying means for setting up and practicing 130° cut shots.

FIG. 3 is a partial view of the training device 10 illustrating the identifying means for setting up and practicing the 130° angle cue shot SG. The cue ball is placed on position 21 which is centered on a cue ball line of travel 22. The object ball is placed on position 23 which is centered on an object ball line of travel 24. The player strikes the cue ball at position 21 with the cue stick in such a manner that it rolls along the line of travel 22 and impacts the object ball at position 23 at the impact point 25, such that the object ball then rolls along line of travel 24. An edge 18 of the practice device 10 is placed on the billiard table 12, such that the line of travel 24 is directed toward a pocket 28. The angle 29 between the cue ball line of travel 22 and the object ball line of travel 24 is 130°. Identifying lines 30 and 31 parallel to the cue ball line of travel 22 are provided to allow the player to practice using English. The lines 30 and 31 are the subject of FIG. 4.

Figure 4:
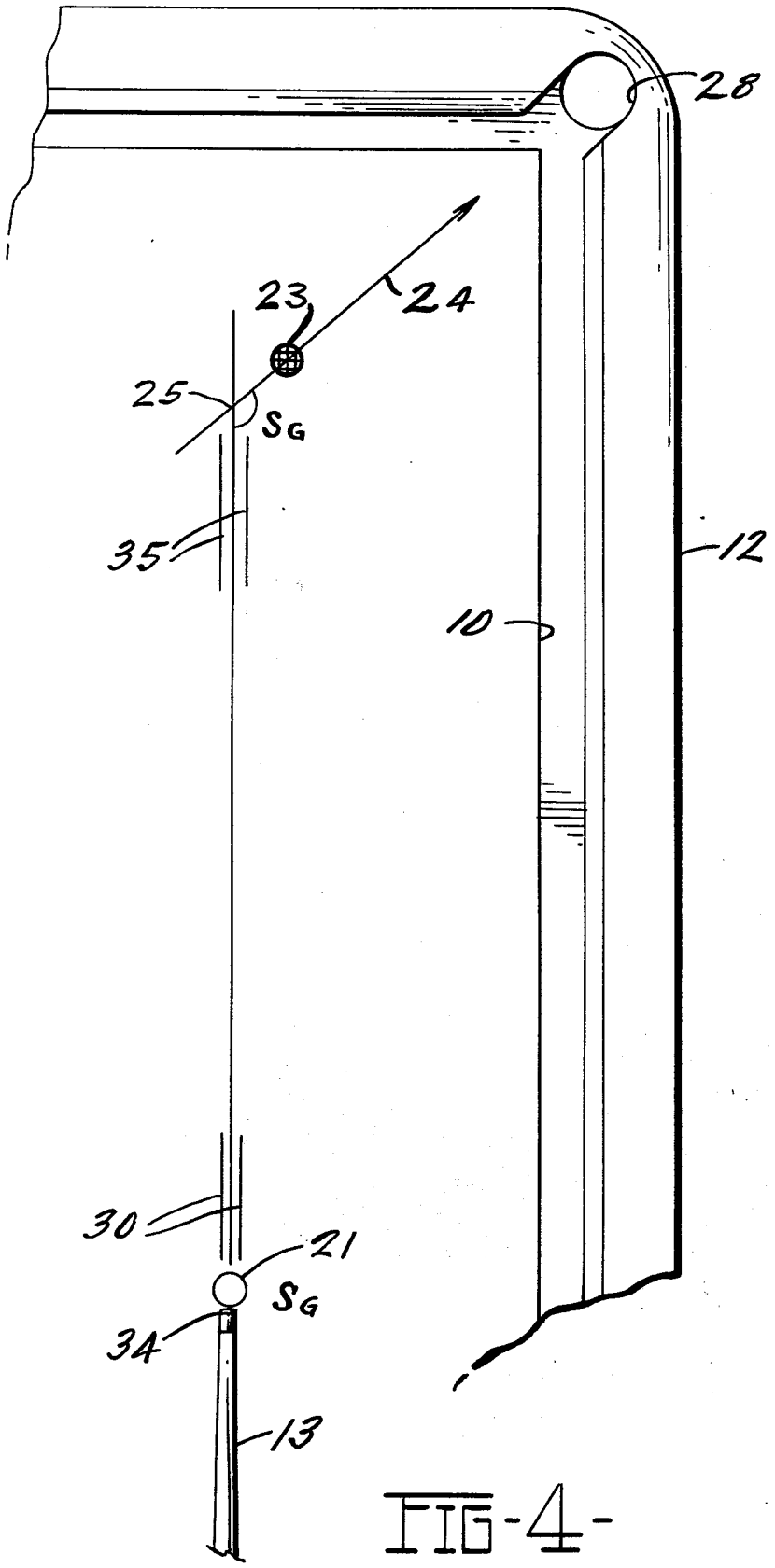
FIG. 4 is a partial plan view of the training device on a table as shown in FIG. 3, illustrating the use of the device for practicing shots with English.

FIG. 4 is a partial view of the training device 10 illustrating the means for using the device 10 to practice shots with English. A billiard shot is made to have English, i.e., a horizontal component of twist or spin, by striking the cue ball on one side, as opposed to striking it in the center. The reasons for imparting English to the cue ball are well known in the literature and to persons skilled in billiards, and include such things as preventing scratches (cue ball rolling into a billiard pocket), strategic placement of the cue ball in preparation for the next shot, and imparting favorable spin to the object ball (for example, a spin toward the rail in long rail shots). When English is imparted to a cue ball, its line of travel is slightly curved. The degree of curvature depends upon the amount of English (horizontal spin), the speed of the ball, and the nap of the playing surface. The practice device 10 and method of the present invention allows the player to practice shots with English in a controlled and repetitive manner so that he becomes skilled in its use. In FIG. 4 the cue ball is centered on position 21 as discussed above in regard to FIG. 3. The shot is first lined up as discussed in FIG. 3. The cue stick then is aimed so that it coincides with one of the identifying lines 30 for practicing English (left or right side depending upon the desired direction of spin). The stick is then pivoted about its tip 34 by adjusting the bridge so that the player is then aiming along one of the identifying lines 35 which is on the same side of the cue ball line of travel as the selected identifying line 30. The player then smoothly strokes the cue stick, striking the cue ball as described, resulting in a path of travel which brings the cue ball to the point of impact 25. The English lines 35 and 30 greatly reduce the amount of time needed to teach a person the use of English. The cue ball impacts the object ball 23, causing the object ball 23 to roll along the line of travel 24 with a horizontal component of spin in the opposite direction of the cue ball English. The cue ball rebounds from the impact with a resulting line of travel favoring the direction of its English. By repetitively performing the exact same English shot, the player gains confidence and skill in its use, and thereafter may choose the type (right or left) of English to give the desired results or rebounds after impact.

The above description is typical of the method of use of the training device 10. While the FIG. 3 and FIG. 4 layouts are merely representative of the two specific practice shots, and while several other practice shots are indicated in FIG. 2, it is understood that numerous other shots are possible by varying the specific embodiments of the identifying means 16.

I claim:

1. A pocket billiards training device for use on a billiard table having a playing area comprising, a layer of cloth material having an upper surface and a lower surface, said layer of material being of an area less than such playing area of such billiard table and identifying means on said upper surface of said layer of cloth material for guiding a player in making predetermined billiard shots, said lower surface including a nap for gripping such billiard table playing area.

2. A pocket billiards training device, according to claim 1, wherein said upper surface of said layer of cloth material is of a first color and said identifying means comprises individual layers of pre-arranged indicia of a second color contrasting to such first color.

3. A pocket billiards training device as described in claim 1, wherein said identifying means includes at least one set of parallel English lines.

4. A pocket billiards training device as described in claim 1, including adhesive means on said lower surface.

5. A pocket billiards training device for use on a billiard table having a playing area comprising, a layer of planar material having an upper surface and a lower surface, said layer of planar material being of an area less than such playing area of such billiard table and identifying means on said upper surface of said layer of planar material for guiding a player in making predetermined billiard shots, said identifying means including at least one set of parallel English guidelines and said lower surface including means for gripping such billiard table playing area.

6. A pocket billiards training device, according to claim 5, wherein said layer of planar material is a layer of cloth.

7. A pocket billiards training device, according to claim 5, wherein said gripping means comprises at least one strip of an adhesive layer.

8. A pocket billiards training device as described in claim 5, wherein said layer of planar material is a layer of cloth and said means for gripping such billiard table playing area comprises the nap of the lower surface of said cloth layer.

9. A pocket billiards training device as described in claim 5, wherein said gripping means comprises adhesive means.

10. A pocket billiards training device, as described in claim 5, wherein said upper surface is of a first color and said identifying means includes pre-arranged indicia of a second color.

* * * * *